US009660393B2

(12) United States Patent
Shinmi

(10) Patent No.: US 9,660,393 B2
(45) Date of Patent: May 23, 2017

(54) CONNECTOR FITTED WITH SHORTING TERMINAL

(71) Applicant: YAZAKI CORPORATION, Tokyo (JP)

(72) Inventor: Yoshifumi Shinmi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/062,495

(22) Filed: Mar. 7, 2016

(65) Prior Publication Data

US 2016/0190750 A1 Jun. 30, 2016

Related U.S. Application Data

(63) Continuation of application No. PCT/JP2014/074323, filed on Sep. 12, 2014.

(30) Foreign Application Priority Data

Sep. 13, 2013 (JP) ..... 2013-190854

(51) Int. Cl.
*H01R 13/70* (2006.01)
*H01R 13/703* (2006.01)

(52) U.S. Cl.
CPC ..... *H01R 13/7032* (2013.01)

(58) Field of Classification Search
CPC ..... H01R 13/7032
See application file for complete search history.

(56) References Cited

U.S. PATENT DOCUMENTS 4,978,311 A 12/1990 Oda et al.
6,186,805 B1 2/2001 Krishnaswamy et al.
7,955,104 B1 * 6/2011 Wicks ..... H01R 13/7032 439/188
2002/0197897 A1 12/2002 Osada

FOREIGN PATENT DOCUMENTS

JP 2-117453 A 5/1990
JP 2003-7393 A 1/2003
JP 2011-49043 A 3/2011
JP 2012-134004 A 7/2012

OTHER PUBLICATIONS

International Search Report and Written Opinion of the International Search Report for PCT/JP2014/074323 dated Oct. 7, 2014.
International Preliminary Report on Patentability and English language Written Opinion of the International Search Report for PCT/JP2014/074323.

* cited by examiner

*Primary Examiner* — Ross Gushi
(74) *Attorney, Agent, or Firm* — Kenealy Vaidya LLP

(57) ABSTRACT

In a connector fitted with a shorting terminal, both sides of an elastic member included in the shorting terminal are respectively provided with abutting parts to form one pair on the left and right, and each of the abutting parts can be independently elastically deformed and also biases two terminals to maintain a shorted state. When the connector fits with a mating connector housing, a short-cancellation member makes contact with a cancellation part and the abutting part is separated from the terminal to cancel the shorted state.

2 Claims, 9 Drawing Sheets

CONNECTOR FITTED WITH SHORTING TERMINAL

CROSS REFERENCE TO RELATED APPLICATIONS

This application is a continuation of PCT application No. PCT/JP2014/074323, which was filed on Sep. 12, 2014 based on Japanese Patent Application (No. P2013-490854) filed on Sep. 13, 2013, the contents of which are incorporated herein by reference.

BACKGROUND OF THE INVENTION

1. Field of the Invention

The present invention relates to a connector fitted with a shorting terminal.

2. Description of the Related Art

Generally, an airbag is installed as an occupant protection system of a vehicle and the airbag is instantaneously blown by energization of an inflator. However, when a potential difference between electric wires is caused by electromagnetic waves or static electricity before connection of the inflator, the airbag may be opened due to a malfunction in the inflator. As a result, it is known that a connector for energizing the inflator is provided with a shorting terminal for shorting a terminal of the distal end of the electric wire until just after the connection is started (see Patent Reference 1 described below, for instance).

A short spring (shorting terminal) 120 attached to a connector 300 fitted with the shorting terminal of Patent Reference 1 shown in FIG. 9 is formed using a metal plate having conductivity and elasticity, and includes a substrate part 121 with a flat plate shape, a pair of elastic members 122 formed so as to overhang upwardly with the elastic members cantilevered in the substrate part 121, abutting parts 124 respectively formed on the tops of the pair of elastic members 122, a joining part 126 for joining the pair of elastic members 122, elastic support parts 200 for elastically supporting the pair of elastic members 122, and a tongue-shaped pressing movement part 201 for biasing the pair of elastic members 122 against elastic forces of the elastic support parts 200 as shown in FIG. 9A.

As shown in FIG. 9B, the connector 300 fitted with the shorting terminal includes a male connector housing (mating connector housing) 140, and a female connector housing (connector fitted with the shorting terminal) 100. The shorting terminal 120 is inserted into a spring accommodating chamber 210 of the female connector housing 100, and at the time of this insertion, each of the elastic support parts 200 is flexed and its height is shortened. Then, at a point in time when the shorting terminal 120 is completely inserted, the abutting parts 124 are positioned in positions corresponding to two terminal accommodating chambers 112 just over the spring accommodating chamber 210. When female terminals (mating terminals) 150 are inserted into the terminal accommodating chambers 112, all of the pair of elastic members 122 in the shorting terminal 120 is depressed in a downward direction X. However, the elastic force of each of the elastic support parts 200 acts, with the result that the abutting part 124 elastically abuts on a side surface of the terminal 150 of the other side, and surely makes contact without poor contact etc.

Next, when the end of the connector housing 140 of the other side is inserted and is pushed as it is, the distal end of a short-cancellation bar (short-cancellation member) 141 formed on the connector housing 140 of the other side abuts on an upper surface of the elastic support part 200 before complete fitting. Then, at a point in time when the shorting terminal 120 is depressed in the downward direction X by the short-cancellation member 141 and the connector 100 fitted with the shorting terminal completely fits with the connector housing 140 of the other side, the abutting part 124 changes into non-contact with a terminal 130. However, it is disclosed that a malfunction in the airbag due to static electricity etc. can be prevented since the terminal 150 of the other side makes contact with the terminal 130 in a state capable of energization before this non-contact.

Patent Reference 1 is JP-A-2011-49043.

SUMMARY OF THE INVENTION

However, the shorting terminal 120 attached to the connector 100 fitted with the shorting terminal shown in Patent Reference 1 has a problem that the whole shorting terminal 120 is deformed and plastic deformation may be caused.

The invention has been implemented in view of the above circumstances, and one of the objects of the invention is to provide a connector fitted with a shorting terminal in which the amount of deformation of the shorting terminal is decreased to prevent plastic deformation.

The above object of the invention is achieved by the following configurations.

(1) A connector fitted with a shorting terminal, including:

a connector housing having plural terminal accommodating chambers capable of accommodating plural terminals, and the shorting terminal which is attached to the at least one of the terminal accommodating chambers and makes contact with at least two accommodated terminals to thereby set the two terminals in a shorted state, wherein when the connector fitted with the shorting terminal fits with a mating connector housing, a short-cancellation member formed on the mating connector housing makes contact with the shorting terminal and the shorting terminal is deformed to cancel the shorted state, and the shorting terminal includes a substrate part fixed to the terminal accommodating chamber, and an elastic member which is cantilevered in the substrate part through a connecting part and being elastically deformable relatively to the substrate part, and the elastic member includes a pair of abutting parts, each of the abutting parts being independently capable of elastic deformation and also being capable of making contact with the two different terminals, and a cancellation part that cancels the shorted state by making contact with the short-cancellation member when the connector fitted with the shorting terminal fits with the mating connector housing, and the cancellation part is formed in a position nearer to the connecting part than a shorting part for making contact with the terminal in each of the abutting parts.

(2) The connector fitted with the shorting terminal with the configuration of the above (1), wherein the pair of abutting parts is constructed of a pair of elastic springs extending from en end opposite to an end of a side connected to the connecting part in the elastic member, and the cancellation part is constructed of a curved plate material formed between the pair of elastic springs.

According to the connector fitted with the shorting terminal with the configuration of the above (1), each of the abutting parts of the elastic member can be independently elastically deformed, with the result that the two different terminals can accurately be biased respectively. That is, there are dimension errors in manufacture or assembly between the abutting parts of the elastic member and the terminals accommodated in the terminal accommodating chambers, but the pair of abutting parts is independently elastically deformed, with the result that each of the terminals can surely be biased to maintain the stable shorted state. Also, the cancellation part is formed in the position nearer to the connecting part than the shorting part for making contact with the terminal in each of the abutting parts and thereby, a pressing force by which the shorting terminal is canceled from the shorted state can be decreased and a load on the short-cancellation member can be reduced. Further, since the amount of deformation of the elastic member is small, plastic deformation of the shorting terminal can also be prevented.

According to the connector fitted with the shorting terminal with the configuration of the above (2), the pair of abutting parts is constructed of the pair of elastic springs and thereby, an elastic force of the elastic member on the terminal is held for a long time and the stable shorted state is maintained and also at the time of actuation of the connector fitted with the shorting terminal, the shorted state is canceled surely. Also, the shorting terminal is smoothly returned after actuation. Further, the cancellation part is constructed of the curved plate material and thereby, the short-cancellation member can easily push up the cancellation part, and instantaneous actuation is performed properly.

According to the connector fitted with the shorting terminal according to the invention, the abutting part of the shorting terminal biases the terminal and the cancellation part is fixed in a predetermined position until the short-cancellation member is actuated, with the result that each of the abutting parts holds an independent function and long-term use can also be secured, and deformation of the elastic member following movement of the cancellation part by the short-cancellation member can be decreased, and plastic deformation of the shorting terminal can be prevented.

The invention has briefly been described above. Further, the details of the invention will become more apparent by reading through a mode (hereinafter called an "embodiment") for carrying out the invention described below with reference to the accompanying drawings.

BRIEF DESCRIPTION OF THE DRAWINGS

FIG. 2A is a perspective view of a state in which a mat seal fits with an outer housing. FIG. 2B is a perspective view of the connector fitted with the shorting terminal in which the fitting is completed.

FIG. 3A is a perspective view. FIG. 3B is a longitudinal sectional view describing elastic action, FIG. 3C is a longitudinal sectional view describing an amount of deformation of the shorting terminal.

FIG. 4A is a schematic diagram describing a state of connection between both terminals. FIG. 4B is a schematic diagram describing a short-cancellation member FIGS. 5A to 5D describe a progress state of fitting between the mating connector housing and the connector fitted with the shorting terminal according to the embodiment of the invention.

FIG. 6A is a perspective view in the vicinity of the terminal, FIG. 6B is a longitudinal sectional view of FIG. 6A. FIG. 6C is a perspective view in the vicinity of the short-cancellation member, FIG. 6D is a longitudinal sectional view of FIG. 6C. Respective left sides in FIGS. 6A to 6D show a state of the middle of the fitting, and respective right sides in FIGS. 6A to 6C show a state of the completion of the fitting.

FIG. 7A shows a state of the start of the fitting. FIG. 7B shows a state of the completion of the fitting FIG. 8A shows a related art. FIG. 8B shows the embodiment. Respective left sides in FIGS. 8A and 8B show a state before fitting, and respective right sides in FIGS. 8A and 8B show a state after fitting.

FIG. 9A is a perspective view of the shorting terminal. FIG. 9B is a sectional view and a partially enlarged view of the shorting terminal connector and a mating connector housing.

DETAILED DESCRIPTION OF THE EXEMPLARY EMBODIMENTS

Figure 1:
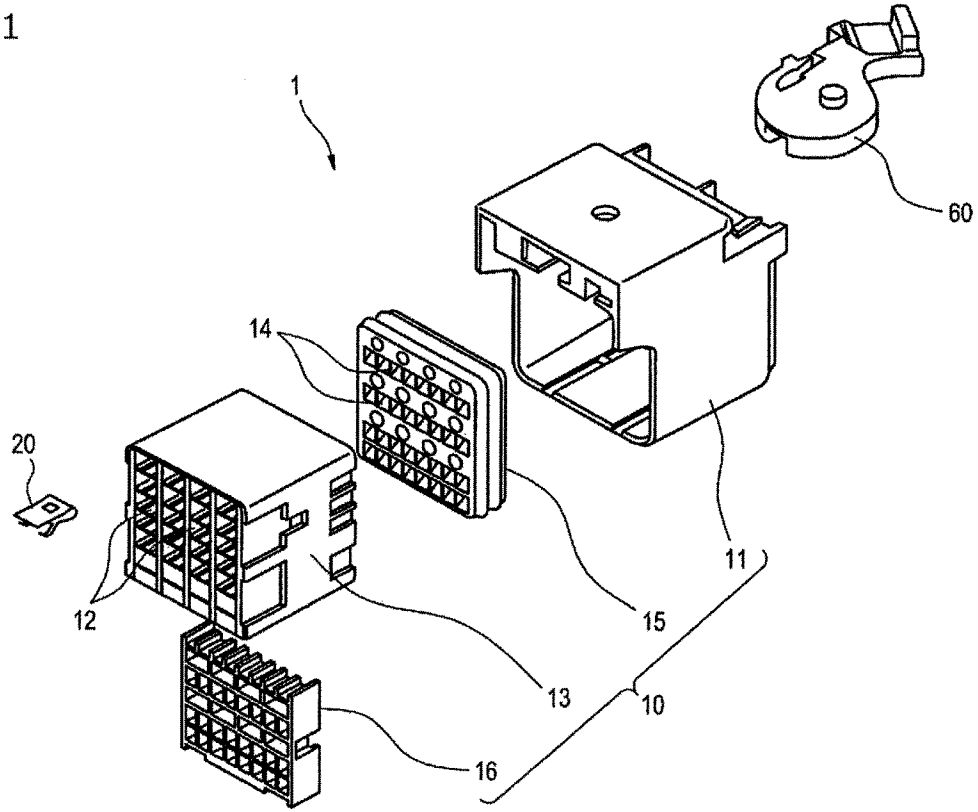
FIG. 1 is an exploded perspective view showing a connector fitted with a shorting terminal according to an embodiment of the invention.

An embodiment according to the invention will hereinafter be described with reference to the drawings. First, each configuration of a connector fitted with a shorting terminal will be described using FIGS. 1 to 3C.

A connector 1 fitted with a shorting terminal according to the embodiment of the invention includes a connector housing 10, and the connector housing 10 has an outer housing 11 made of synthetic resin with substantially a rectangular shape, an inner housing 13 made of synthetic resin with substantially a rectangular shape, the inner housing 13 which is accommodated in the outer housing 11 and is provided with plural terminal accommodating chambers 12 for accommodating plural terminals 30 described below in predetermined positions, a rubber mat seal 15 which is fixed between the outer housing 11 and the inner housing 13 and is provided with plural insertion holes 14 into which the terminals 30 with electric wires are inserted, and a retainer 16 which is inserted from the downward side of the inner housing 13 and is fixed inside the inner housing 13. Also, plural shorting terminals 20 are attached to the terminal accommodating chambers 12, and a lever 60 is accommodated in an upper portion of the outer housing 11.

The mat seal 15 fits with plural protruding parts 17 formed inside the outer housing 11, and is fixed in a predetermined position inside the outer housing 11 (see FIG. 2A), and it is constructed so that plural lip shapes formed on inner walls of the insertion holes 14 of the mat seal 15 ensure waterproofness to the electric wires and plural lip shapes formed on an outer wall of the mat seal 15 ensure waterproofness to a mating connector housing 40.

Figure 2A:
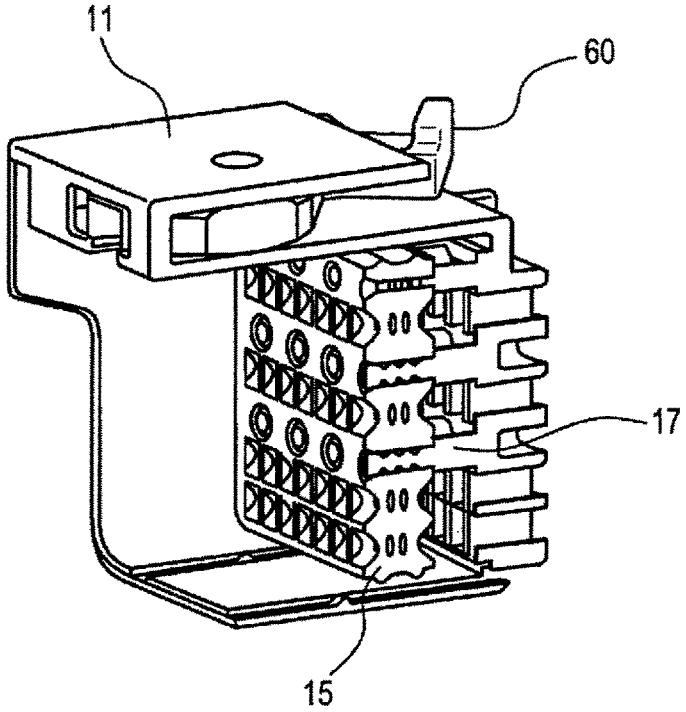
FIGS. 2A and 2B show a fitting state of the connector fitted with the shorting terminal according to the embodiment of the invention.
Figure 2B:
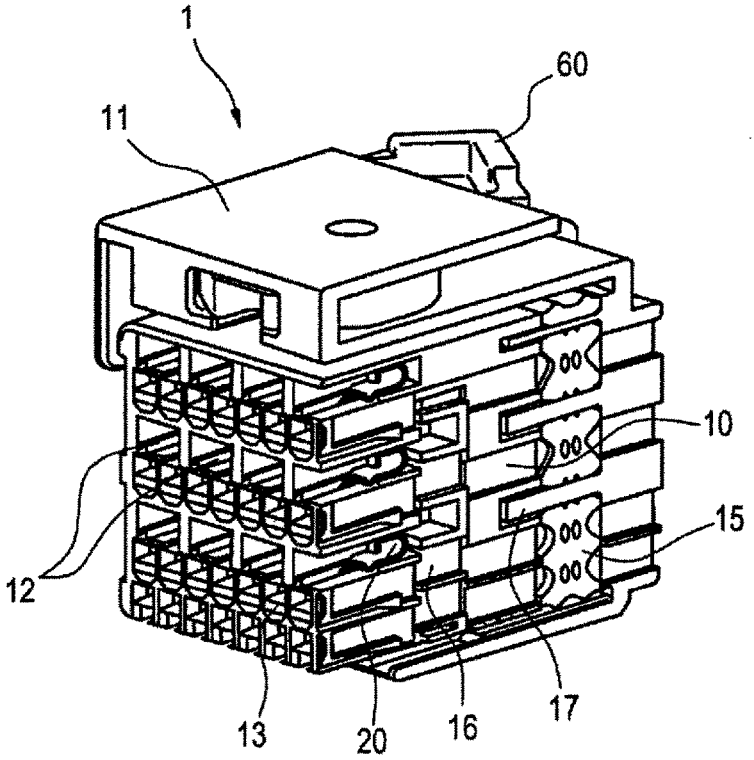

The inner housing 13 to which the shorting terminals 20 are attached and the retainer 16 is fixed fits with the distal ends of the protruding parts 17 of the outer housing 11, and is fixed in the predetermined position inside the outer housing 11 (see FIG. 2B).

<Details of Shorting Terminal>

The shorting terminal 20 (see FIGS. 3A to 3C) is a leaf spring with substantially a U-shaped cross section in which a conductive metal with a flat plate shape is cut and folded and is molded by laser processing etc. The shorting terminal 20 includes a substrate part 21 and an elastic member 22, and the elastic member 22 includes a connecting part 23, abutting parts 24 and a cancellation part 25.

The substrate part 21 has substantially a flat plate rectangular shape, and both sides of the substrate part 21 are provided with plural engaging protrusions 21*a* for fixing the shorting terminal 20 inside the inner housing 13. The connecting part 23 is continuously erected from the end of the substrate part 21, and is folded about 180° in a cross-sectional curved shape. The elastic member 22 is cantilevered in the substrate part 21 via the connecting part 23, and can be elastically deformed relatively to the substrate part 21.

Both sides of the elastic member 22 are respectively provided with the abutting parts 24 to form one pair on the left and right, and the abutting parts 24 extend so as to be separated from the substrate part 21 gradually from the vicinity of the center of the elastic member 22 toward the distal end of the elastic member 22. The distal end of the abutting part 24 is provided with a shorting part 27 capable of making electrical contact with the terminal 30 in a cross-sectional curved plate shape folded toward the substrate part 21. That is, in a pair of abutting parts 24, each of the abutting parts 24 can be independently elastically deformed and can also make contact with the two different terminals 30. And, the pair of abutting parts 24 is constructed of a pair of elastic springs extending from en end opposite to an end of a side connected to the connecting part 23 in the elastic member 22.

The cancellation part 25 is formed between the pair of abutting parts 24 in the vicinity of the center of the elastic member 22, and is formed in a state folded in a cross-sectional curved plate shape toward the substrate part 21. That is, the cancellation part 25 is formed in a position nearer to the connecting part 23 than the shorting part 27 in the abutting part 24. Also, the abutting parts 24 and the cancellation part 25 are formed continuously with the connecting part 23 by a joining part 26 with a slightly recessed shape with respect to the substrate part 21.

The shorting terminal 20 can disperse stress of generation (see FIG. 3B) by elastic action (spring action) caused in the vicinity (part A: see an enclosed broken line) of the connecting part 23 of the elastic member 22 and elastic action caused in the joining part 26 (see an enclosed broken line). Also, since the elastic member 22 is deformed by pressing using a short-cancellation member 41 described below at a point S of the cancellation part 25 near to a center point X of the connecting part 23, a point T of the shorting part 27 can be deformed in a direction of the substrate part 21 by a small amount of deformation (see FIG. 3C).

The operation of the shorting terminal will be described in detail using FIGS. 4A to 7B.

Figure 4A:
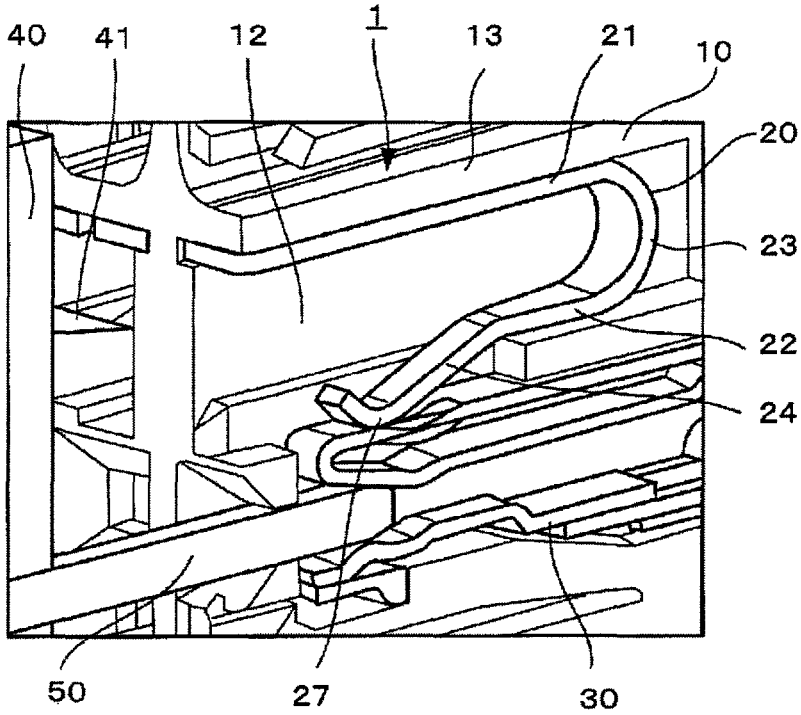
FIGS. 4A and 4B show a relation between a mating connector housing and the connector fitted with the shorting terminal according to the embodiment of the invention.
Figure 4B:
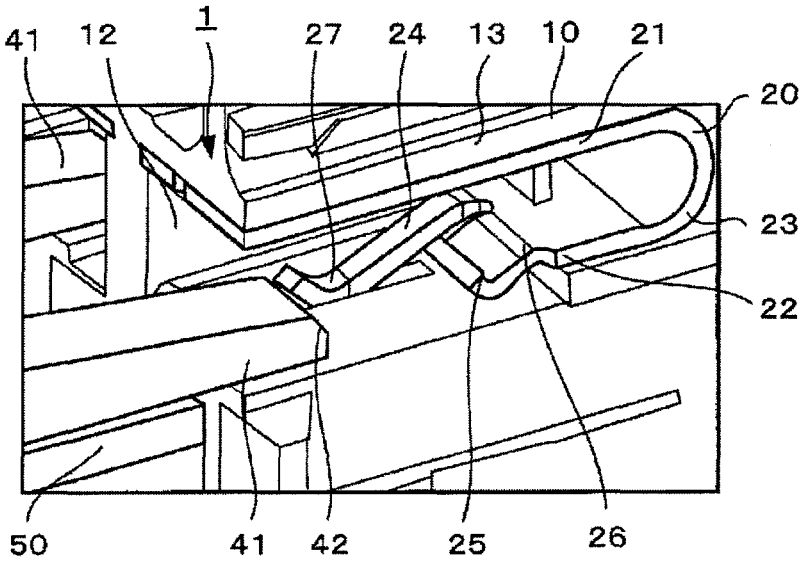
Figure 5A:
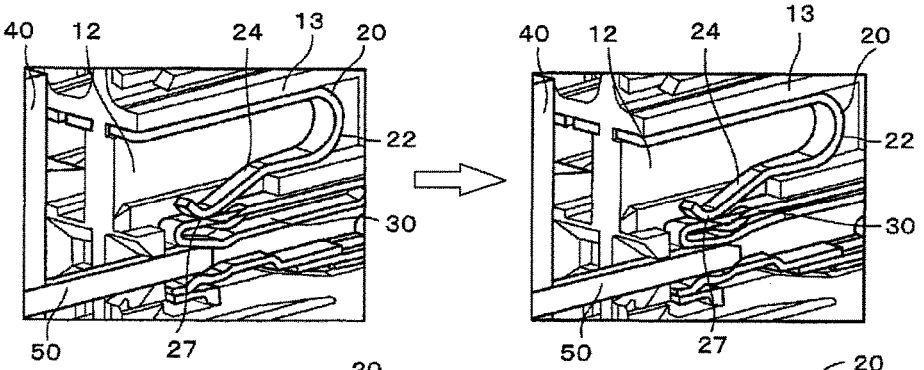
FIG. 5A is a perspective view in the vicinity of the terminal.
Figure 5B:
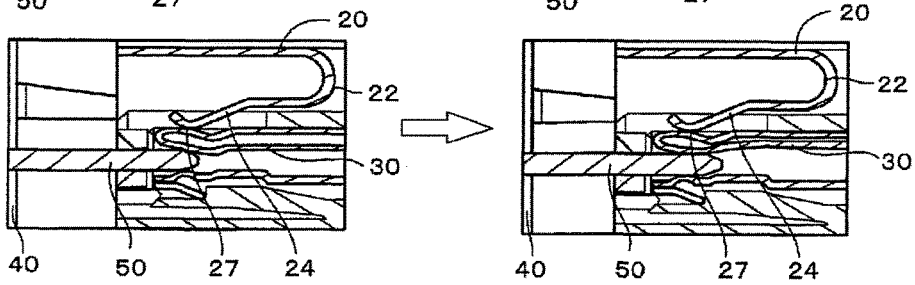
FIG. 5B is a longitudinal sectional view of FIG. 5A.
Figure 5C:
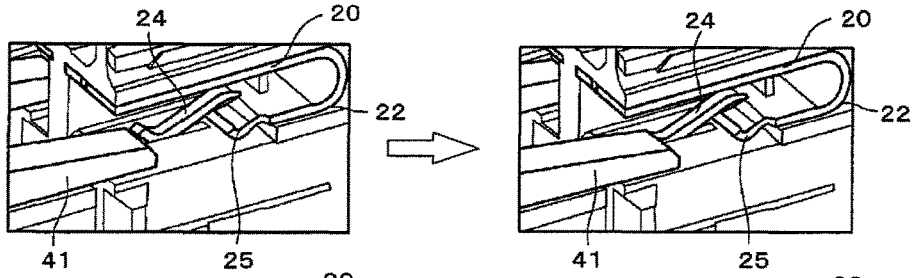
FIG. 5C is a perspective view in the vicinity of the short-cancellation member.
Figure 5D:
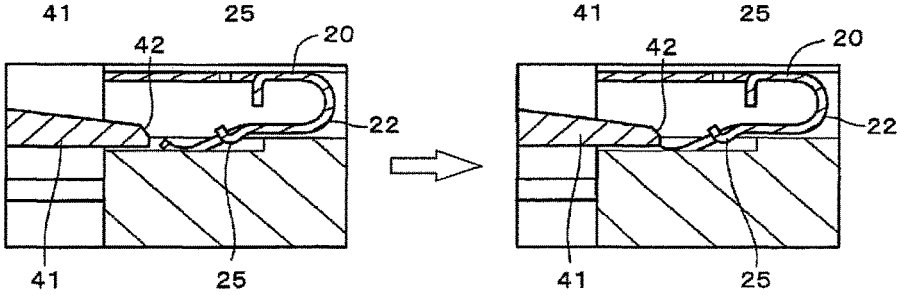
FIG. 5D is a longitudinal sectional view of FIG. 5C. Respective left sides in FIGS. 5A to 5D show a state of the start of fitting, and respective right sides in FIGS. 5A to 5D show a state in which the fitting progresses slightly.
Figure 6A:
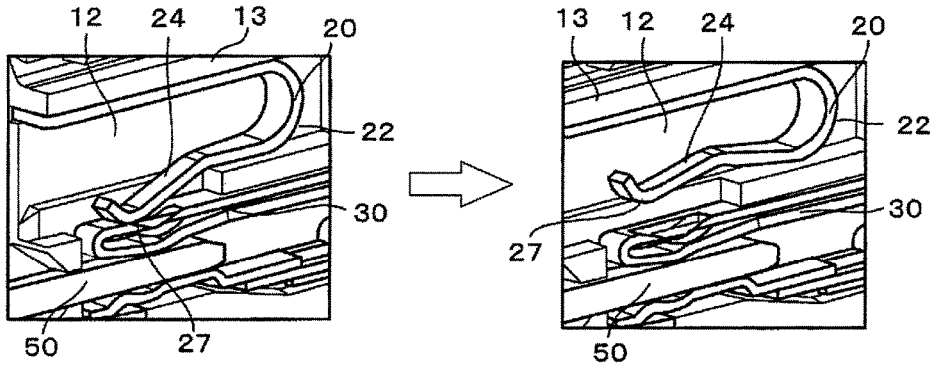
FIGS. 6A to 6D describe a further progress state of the fitting in FIGS. 5A to 5D.
Figure 6B:
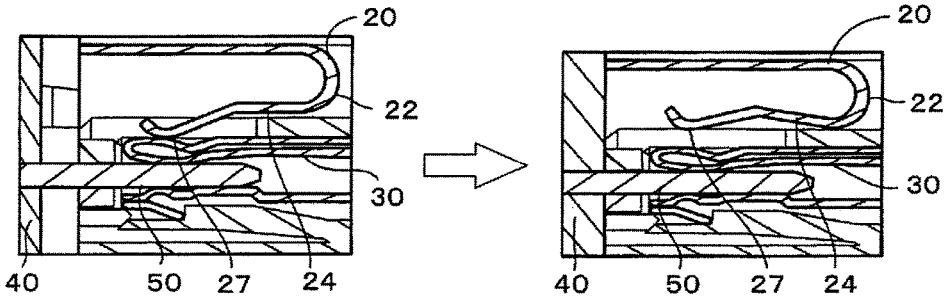
Figure 6C:
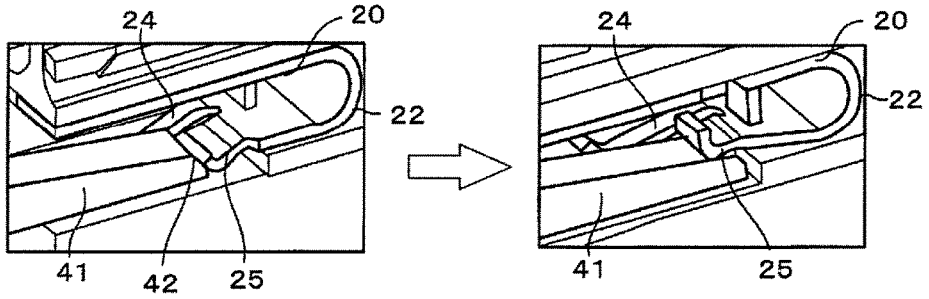
Figure 6D:
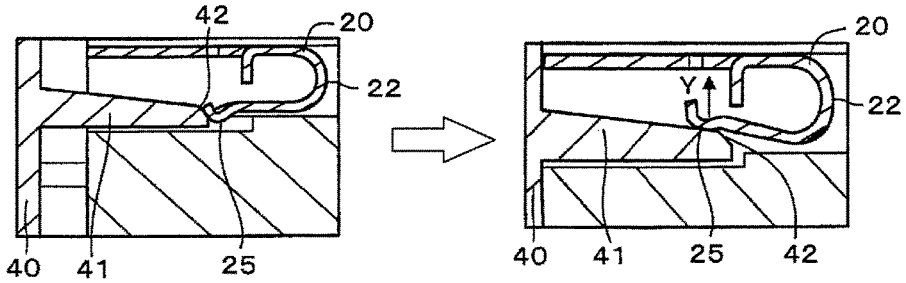

<Relation between the Connector Fitted with Shorting Terminal and the Mating Connector Housing: FIGS. 4A and 4B>

The shorting terminal 20 and the terminal 30 are fixed in a predetermined position inside the terminal accommodating chamber 12 of the inner housing 13 accommodated in the connector housing 10 included in the connector 1 fitted with the shorting terminal, and the shorting part 27 formed on the distal end of the abutting part 24 of the shorting terminal 20 is elastically deformed in a direction of the substrate part 21, and the terminal 30 is biased from the upward side. In FIG. 4A, only one abutting part 24 is disclosed, but the other abutting part 24 also biases the adjacent terminal 30, and the two terminals 30 are set in a shorted state.

When the connector 1 fitted with the shorting terminal fits with the mating connector housing 40, the terminal 30 is electrically bonded to a mating terminal 50 fixed to the mating connector housing 40. In the embodiment, the terminal 30 is shown as a female terminal and the mating terminal 50 is shown as a male terminal, but the embodiment is not particularly limited to this. Also, the connector 1 fitted with the shorting terminal is shown as a female connector and the mating connector housing 40 is shown as a male connector housing, but the embodiment is not particularly limited to this.

The mating connector housing 40 is provided with the short-cancellation member 41 (see FIG. 4B), and the distal end of the short-cancellation member 41 is formed with an inclined part 42 inclined downwardly. As soon as the mating terminal 50 is inserted into the terminal accommodating chamber 12, the short-cancellation member 41 is also inserted into the terminal accommodating chamber 12 toward the cancellation part 25 of the shorting terminal 20. The abutting part 24 is deformed in order to bias the terminal 30, but the cancellation part 25 is arranged in a state separated from an inner wall of the terminal accommodating chamber 12 without being deformed.

That is, the abutting part 24 and the cancellation part 25 can be independently elastically deformed, and even when the abutting part 24 becomes deformed by biasing the terminal 30, the cancellation part 25 is maintained in a predetermined position. Then, when the cancellation part 25 is deformed by the short-cancellation member 41, the abutting part 24 is also deformed so as to follow the cancellation part 25, and the shorted state is canceled.

<Fitting Between the Connector Fitted with Shorting Terminal and the Mating Connector Housing: FIGS. 5A to 6D>

(1) Start of Fitting (Respective Left Sides in FIGS. 5A to 5D)

When fitting between the connector 1 fitted with the shorting terminal and the mating connector housing 40 is started in a state in which the shorting part 27 formed on the abutting part 24 of the shorting terminal 20 biases the terminal 30, the mating terminal 50 is bonded to the terminal 30, and the short-cancellation member 41 is inserted into the terminal accommodating chamber 12.

(2) Slight Progress from Start of Fitting (Respective Right Sides in FIGS. 5A to 5D)

In the state in which the shorting part 27 formed on the abutting part 24 of the shorting terminal 20 biases the terminal 30, the mating terminal 50 is further inserted into the terminal 30 and also, the short-cancellation member 41 is further inserted into the terminal accommodating chamber 12, but the distal end of the short-cancellation member 41 does not make contact with the shorting terminal 20.

(3) Middle of Fitting (Respective Left Sides in FIGS. 6A to 6D)

In the state in which the shorting part 27 formed on the abutting part 24 of the shorting terminal 20 biases the terminal 30, the mating terminal 50 is deeper inserted into the terminal 30 and also, the short-cancellation member 41 is deeper inserted into the terminal accommodating chamber 12, and the distal end of the short-cancellation member 41 makes contact with the cancellation part 25 of the shorting terminal 20. In that case, the inclined part 42 of the short-cancellation member 41 is inserted into a gap formed between the cancellation part 25 and the inner wall of the terminal accommodating chamber 12.

(4) Completion of Fitting (Respective Right Sides in FIGS. 6A to 6D)

The mating terminal 50 is fixed in a predetermined position inside the terminal 30, and the inclined part 42 of the short-cancellation member 41 presses the cancellation part 25 and the cancellation part 25 is deformed in a direction of the substrate part 21 (see a direction of arrow Y) and thereby, the abutting part 24 is simultaneously deformed and the shorting part 27 is separated from the terminal 30 to cancel the shorted state for preventing the risk of causing a potential difference between electric wires by electromagnetic waves or static electricity.

That is, until just before the completion of fitting, the abutting part 24 biases the terminal 30 to maintain the shorted state. The short-cancellation member 41 instantaneously presses the cancellation part 25, but at a point in time when a state of continuity between the terminal 30 and the mating terminal 50 is surely obtained, the shorted state is canceled, with the result that a malfunction due to static electricity etc. does not occur. Also, since the inclined part 42 of the short-cancellation member 41 abuts on the cancellation part 25 with a curved shape, a pressing force of sufficiently overcoming a repulsion force of the cancellation part 25 is generated in the short-cancellation member 41, and the fitting between the connector 1 fitted with the shorting terminal and the mating connector housing 40 can surely be completed, and the shorted state can be canceled instantaneously.

Figure 7A:
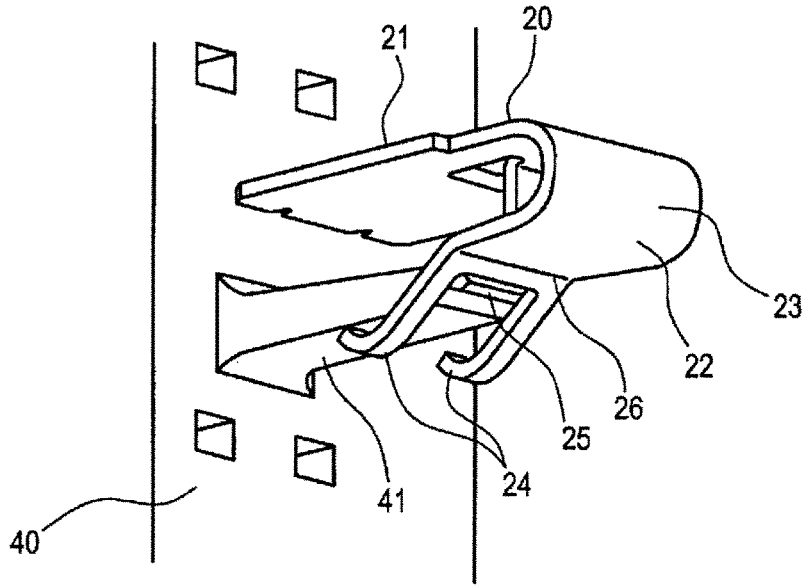
FIGS. 7A and 7B are schematic diagrams showing a relation between the short-cancellation member and a cancellation part of the embodiment.
Figure 7B:
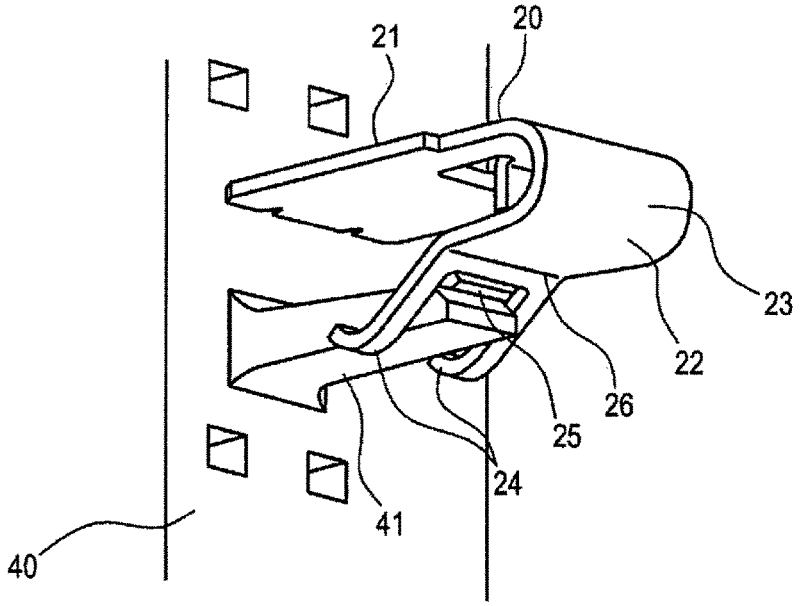

FIGS. 7A and 7B are schematic diagrams showing a relation between the shorting terminal 20 and the short-cancellation member 41. From FIG. 7A, a state in which the short-cancellation member 41 abuts on the cancellation part 25 of the shorting terminal 20 is understood, and from FIG. 7B, it is understood that the inclined part 42 of the short-cancellation member 41 deforms the cancellation part 25 in the direction of the substrate part 21. In addition, the terminal 30 and the mating terminal 50 are not illustrated, but are present under the shorting terminal 20.

Figure 8A:
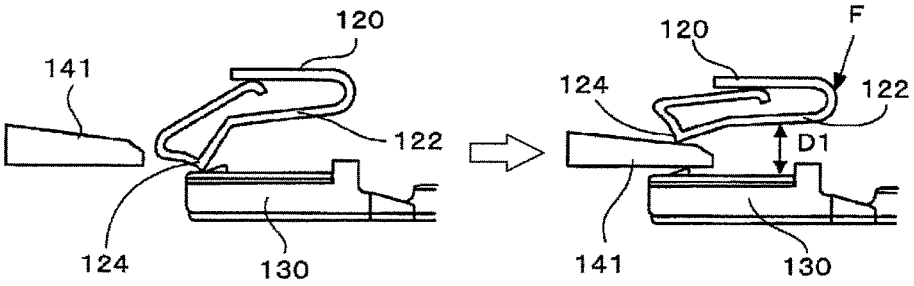
FIGS. 8A and 8B are schematic diagrams describing an effect of the short-cancellation member and the cancellation part of the embodiment.
Figure 8B:
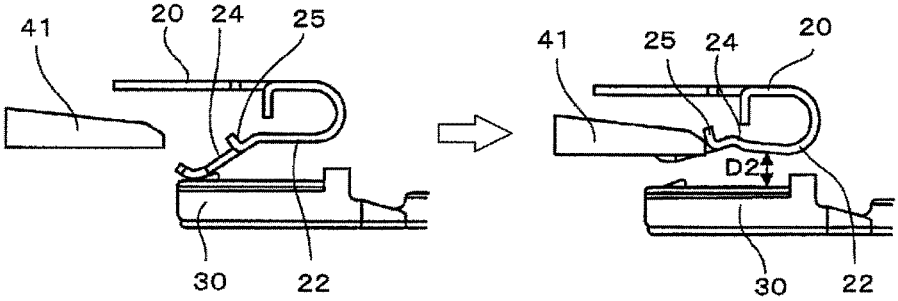
Figure 9A:
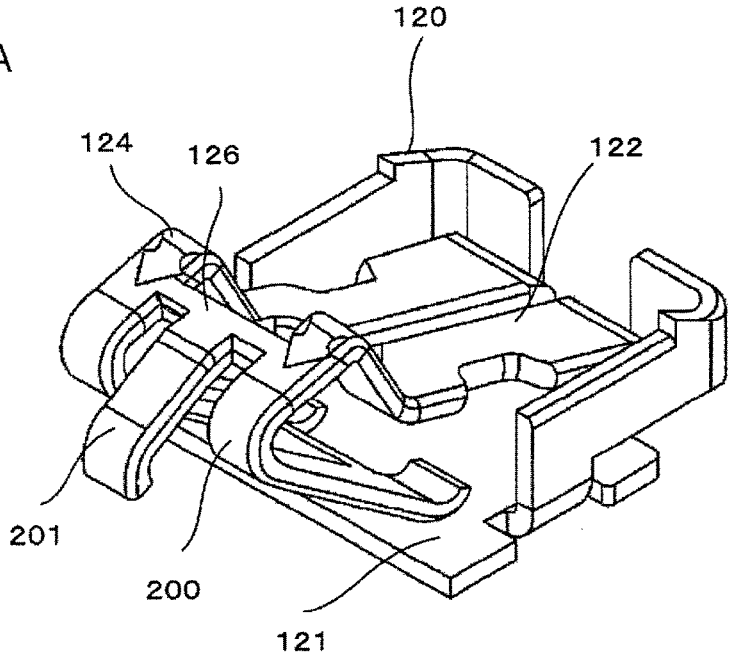
FIGS. 9A and 9B show a related-art connector fitted with a shorting terminal.
Figure 9B:
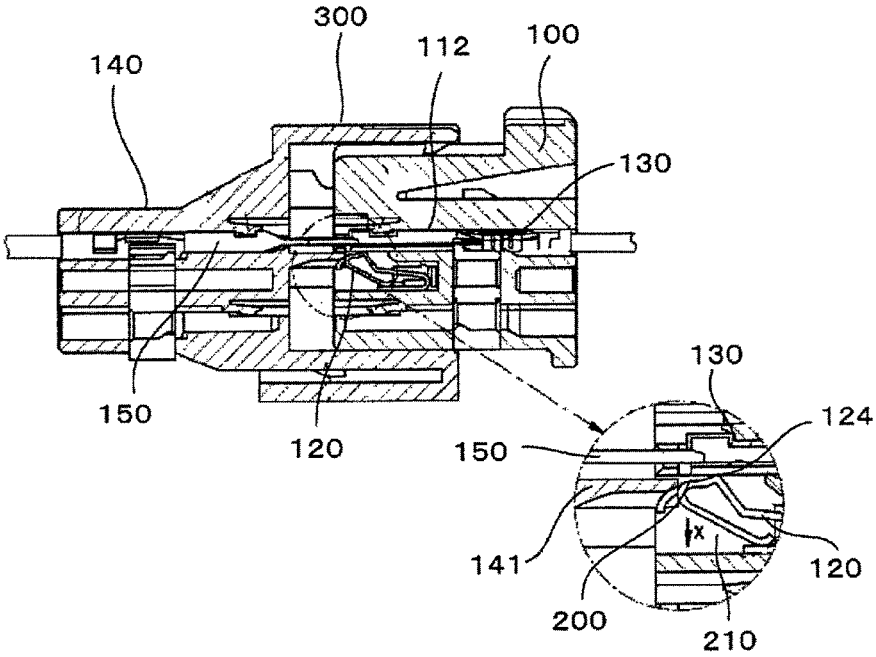

<Comparison with Related Art: FIGS. 8A and 8B>

FIG. 8A is a schematic diagram showing a related art, and FIG. 8B is a schematic diagram showing the embodiment.

In a shorting terminal 120 shown in the related art (the Patent Reference 1) an abutting part 124 abuts on a terminal 130, and shorting of the shorting terminal 120 is canceled by a short-cancellation member 141, but the whole elastic member 122 is deformed in a direction of a substrate part 121, with the result that a deformation amount D1 (distance between the terminal 130 and the abutting part 124) of the shorting terminal 120 is large, and plastic deformation may be caused around a point F. In such a case, it becomes difficult to use the shorting terminal 120 stably for a long time. Also, since the short-cancellation member 141 requires a certain wall thickness or more according to the deformation amount D1, it becomes difficult to miniaturize the connector.

Figure 3A:
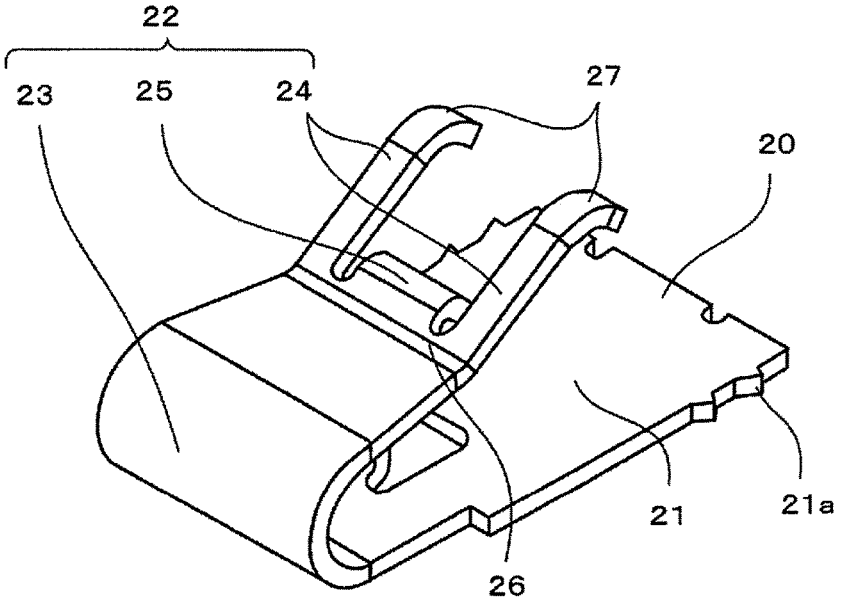
FIGS. 3A to 3C show the shorting terminal according to the embodiment of the invention.
Figure 3B:
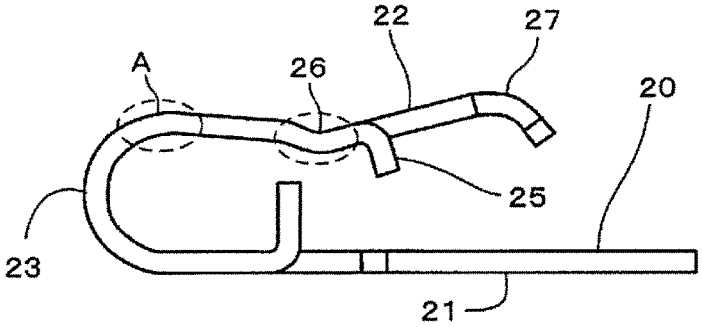
Figure 3C:
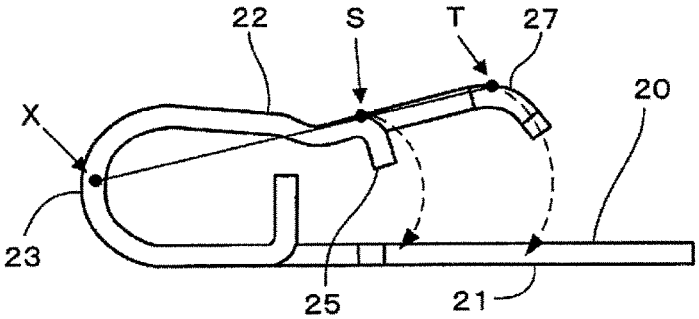

In the embodiment, the short-cancellation member 41 pushes up the cancellation part 25 formed in the vicinity of the center of the shorting terminals 20 and thereby, a deformation amount D2 of the elastic member 22 can be made smaller than that of the related art (D2<D1). That is, the cancellation part 25 is formed in a position nearer to the connecting part than the shorting part 27 in the abutting part 24. Consequently, as shown in FIG. 3C, the elastic member 22 is deformed by pressing using the short-cancellation member 41 at the point S of the cancellation part 25 near to the center point X of the connecting part 23. Hence, the point T of the shorting part 27 can be deformed in the direction of the substrate part 21 by a small amount of deformation.

As a result, the deformation of the elastic member 22 becomes smaller than that of the related art, and plastic deformation of the shorting terminal 20 can be prevented. Consequently, for example, after an airbag is actuated, by only returning the mating connector housing 40 to the original position, it is unnecessary to replace the connector 1 fitted with the shorting terminal to which the shorting terminal 20 is attached, and the connector T can be used stably for a long time.

The connector fitted with the shorting terminal according to the embodiment will hereinafter be summarized.

[1] A connector (1) fitted with a shorting terminal according to the embodiment is the connector (1) fitted with the shorting terminal including a connector housing (10) having plural terminal accommodating chambers (12) capable of accommodating plural terminals (30), and the shorting terminal (20) which is attached to the at least one terminal accommodating chamber (12) and makes contact with the at least two accommodated terminals (30) to thereby set the two terminals (30) into a shorted state, and when the connector (1) fitted with the shorting terminal fits with a connector housing (40) of the other side, a short-cancellation member (41) formed on the connector housing (40) of the other side makes contact with the shorting terminal (20) and the shorting terminal (20) is deformed to thereby cancel the shorted state, and the shorting terminal (20) includes a substrate part (21) fixed to the terminal accommodating chamber (12), and an elastic member (22) which is cantilevered in the substrate part (21) through connecting part (23) and can be elastically deformed relatively to the substrate part (21), and the elastic member (22) includes a pair of abutting parts (24), each of the abutting parts being independently capable of elastic deformation and also being capable of making contact with the two different terminals (30), and a cancellation part (25) for canceling the shorted state by making contact with the short-cancellation member (41) when the connector (1) fitted with the shorting terminal fits with the connector housing (40) of the other side, and the cancellation part (25) is formed in a position nearer to the connecting part (23) than a shorting part (27) for ma king contact with the terminal (30) in each of the abutting parts (24).

[2] The connector (1) fitted with the shorting terminal according to the embodiment is characterized in that the pair of abutting parts (24) is constructed of a pair of elastic springs extending from en end opposite to an end of a side connected to the connecting part (23) in the elastic member (22), and the cancellation part (25) is constructed of a curved plate material formed between the pair of elastic springs.

In addition, the invention is not limited to the embodiment described above, and changes, improvements, etc. can be made properly. Moreover, as long as the invention can be achieved, materials, shapes, dimensions, the number of components, arrangement places of each component in the embodiment described above are freely selected and are not limited.

The invention has been described in detail with reference to the specific embodiment, but it is apparent to those skilled in the art that various changes or modifications can be made without departing from the spirit and scope of the invention.

According to a connector fitted with a shorting terminal according to the invention, an abutting part of the shorting terminal biases a terminal and a cancellation part is fixed in a predetermined position until a short-cancellation member is actuated, with the result that each of the abutting parts holds an independent function and long-term use can also be secured, and deformation of an elastic member following movement of the cancellation part by the short-cancellation member can be decreased, and plastic deformation of the shorting terminal can be prevented. The invention having this effect is useful for the connector fitted with the shorting terminal.

What is claimed is:

1. A connector fitted with a shorting terminal, comprising:

a connector housing having plural terminal accommodating chambers capable of accommodating plural terminals, and the shorting terminal which is attached to at least one of the plural terminal accommodating chambers and makes contact with at least two accommodated terminals to set the two terminals in a shorted state, wherein when the connector fitted with the shorting terminal fits with a mating connector housing, a short-cancellation member formed on the mating connector housing makes contact with the shorting terminal and the shorting terminal is deformed to cancel the shorted state, the shorting terminal includes a substrate part fixed to the terminal accommodating chamber, and an elastic member which is cantilevered in the substrate part and being elastically deformable relatively to the substrate part, the elastic member comprises a connecting part folded in a curved shape, a pair of abutting parts, each of the abutting parts being independently capable of elastic deformation and including a shorting part configured to contact with each of the two terminals, and a cancellation part that cancels the shorted state by making contact with the short-cancellation member when the connector fitted with the shorting terminal fits with the mating connector housing, the cancellation part includes a free end that terminates at a position nearer to the connecting part than is the shorting part, and the shorting terminal is formed in a U shape as a whole with the elastic member cantilevered in the substrate part via the connecting part.

2. The connector fitted with the shorting terminal according to claim 1, wherein the pair of abutting parts is constructed of a pair of elastic springs extending from an end opposite to the connecting part in the elastic member, and the cancellation part is constructed of a curved plate material formed between the pair of elastic springs.

* * * * *